US006592089B1

(12) United States Patent
Leguil

(10) Patent No.: US 6,592,089 B1
(45) Date of Patent: Jul. 15, 2003

(54) STRUT CLAMP

(76) Inventor: Steven F. Leguil, 8024 Woodlawn Dr. NE., Mounds View, MN (US) 55112-6044

( * ) Notice: Subject to any disclaimer, the term of this patent is extended or adjusted under 35 U.S.C. 154(b) by 0 days.

(21) Appl. No.: 10/193,601

(22) Filed: Jul. 9, 2002

(51) Int. Cl.[7] ..... E04G 3/09
(52) U.S. Cl. ..... 248/228.3; 81/424; 403/308
(58) Field of Search ..... 248/229.12, 229.13, 248/229.22, 229.23, 228.4, 228.3; 81/424; 403/308, 378, 103, 389

(56) References Cited

U.S. PATENT DOCUMENTS

| | | | | | |
|---|---|---|---|---|---|
| 3,208,560 A | | 9/1965 | Cote | 189/36 |
| 3,677,129 A | | 7/1972 | Lyon | 84/453 |
| 3,687,407 A | | 8/1972 | Dickerson | 248/59 |
| 5,020,519 A | * | 6/1991 | Hayes et al. | 606/237 |
| 5,021,008 A | * | 6/1991 | Scherer | 439/504 |
| 5,143,359 A | * | 9/1992 | Bush | 269/6 |
| 5,255,579 A | * | 10/1993 | Fortin | 81/424 |
| 5,423,236 A | | 6/1995 | Bickler | 81/302 |

* cited by examiner

*Primary Examiner*—Ramon O. Ramirez
(74) *Attorney, Agent, or Firm*—Nikolai & Mersereau, P.A.

(57) ABSTRACT

A tool for clamping onto a strut for holding objects such as pipes in place while they are being attached to the struts is disclosed. The clamp has opposing jaws, which are drawn together by movement of a handle, for pinching the lips of the strut and holding firmly thereto while holding objects adjacent the clamp. A handle on the clamp locks into a pinching position and can be released by opposite motion of the handle. Various attachments to the clamp housing can be used for holding different objects. The clamp has adjustable jaw positions for adjustable pinch strengths. The jaws are biased together when not engaging the strut to allow easy access to the strut for engaging the strut lips or removing the clamp from the strut. Use of the clamp allows one man to install pipes faster safer and easier and without the aid of a helper.

17 Claims, 7 Drawing Sheets

STRUT CLAMP

BACKGROUND OF THE INVENTION

1. Field of the Invention

This invention relates to a clamp for releasably engaging struts and temporarily supporting pipes adjacent thereto until a permanent connection can be made.

2. Description of the Related Art

In construction of buildings struts are used to hold pipes, electrical conduit and other objects. For example, installing a long, heavy length of pipe to struts hanging from the ceiling currently takes two people, one at each end of the pipe. One person will hold the pipe on one end and the other person will connect the pipe to the previous section and make a permanent connection to the strut. The second person can then connect his end of the pipe to the strut. Typically these pipes are attached to the ceiling or a wall thus requiring two ladders or lifts and the coordinated movements of two people. If one end of the pipe is dropped it can be dangerous and can damage objects below. It is desired to have a device which will temporarily hold a pipe adjacent a strut in a secure manner to eliminate the need for a second person during installation of the pipe. It is further desired to have a simple tool for aligning the pitch of the pipes.

SUMMARY OF THE INVENTION

A clamp for attachment to struts is provided wherein two opposing jaws are drawn together and locked into position on the lips of the strut. The clamp has attachments for holding pipes or other devices needed for construction.

The clamp allows one person to do the job of two people by holding one end of a pipe adjacent a strut while the other end is being worked on. The clamp improves the safety of the handling of the pipes, while saving time by making it quicker to install pipe. The clamp can be used in all positions, be installed with one hand, will lock in place and stay tight. The clamp has adjustable pinch strength and can be used on horizontal or vertical installations. The clamp has a fixed jaw and a movable jaw, which engages and holds the lip of a strut. A handle on the clamp pulls the jaws together and locks them into place to fix the clamp to the struts. Attachments to the clamp hold pipes or other objects in place while being connected to the struts allowing one man to do the work of two or more men.

Attachments to the clamp allow for holding pipes or other objects until they are permanently attached to the struts. Other attachments to the clamp are used for leveling or pitching the pipes. A laser attached to a clamp can provide a site line for pipes or for positioning of struts. A trapeze strut can be adjusted on its rods for height by use of a laser for sighting pitch of the strut locations for pipes to rest on the struts.

OBJECTS OF THE INVENTION

It is an object of the invention to safely yet temporarily attach pipes to struts during the permanent installation process.

It is an object of the invention to hold pipes level for level installation.

It is an object of the invention to hold pipes at predetermined angles for pitched installation.

It is an object of the invention to provide the clamp with accessories for use in hanging objects from struts.

It is an object of the invention to provide the clamp with accessories for aligning or angling two struts for connection.

It is an object of the invention to allow one person to hang pipe from struts.

It is an object of the invention to allow quick and easy leveling of the strut hangers themselves.

It is an object of the invention to quickly and easily attach the clamp to a strut.

It is an object of the invention to quickly and easily remove the clamp from a strut.

It is an object of the invention to provide the clamp various easy to attach accessories allowing multiple uses for the clamp.

Other objects, advantages and novel features of the present invention will become apparent from the following description of the preferred embodiments when considered in conjunction with the accompanying drawings.

DESCRIPTION OF THE PREFERRED EMBODIMENTS

In construction projects gas pipes, water pipes, compressed air pipes, ducting, electrical conduit, fire sprinklers, hoses, cables, struts, supports, and other items are connected to or held by struts. The struts may be vertical or horizontal. Long heavy length of pipe generally require a two man crew to install the pipe, one to hold one end of the pipe and the other to hold the other end and attach it to an adjoining pipe and or secure it to a strut. Struts have a standardized shape the cross section of which can be seen in FIG. 1.

Figure 1:
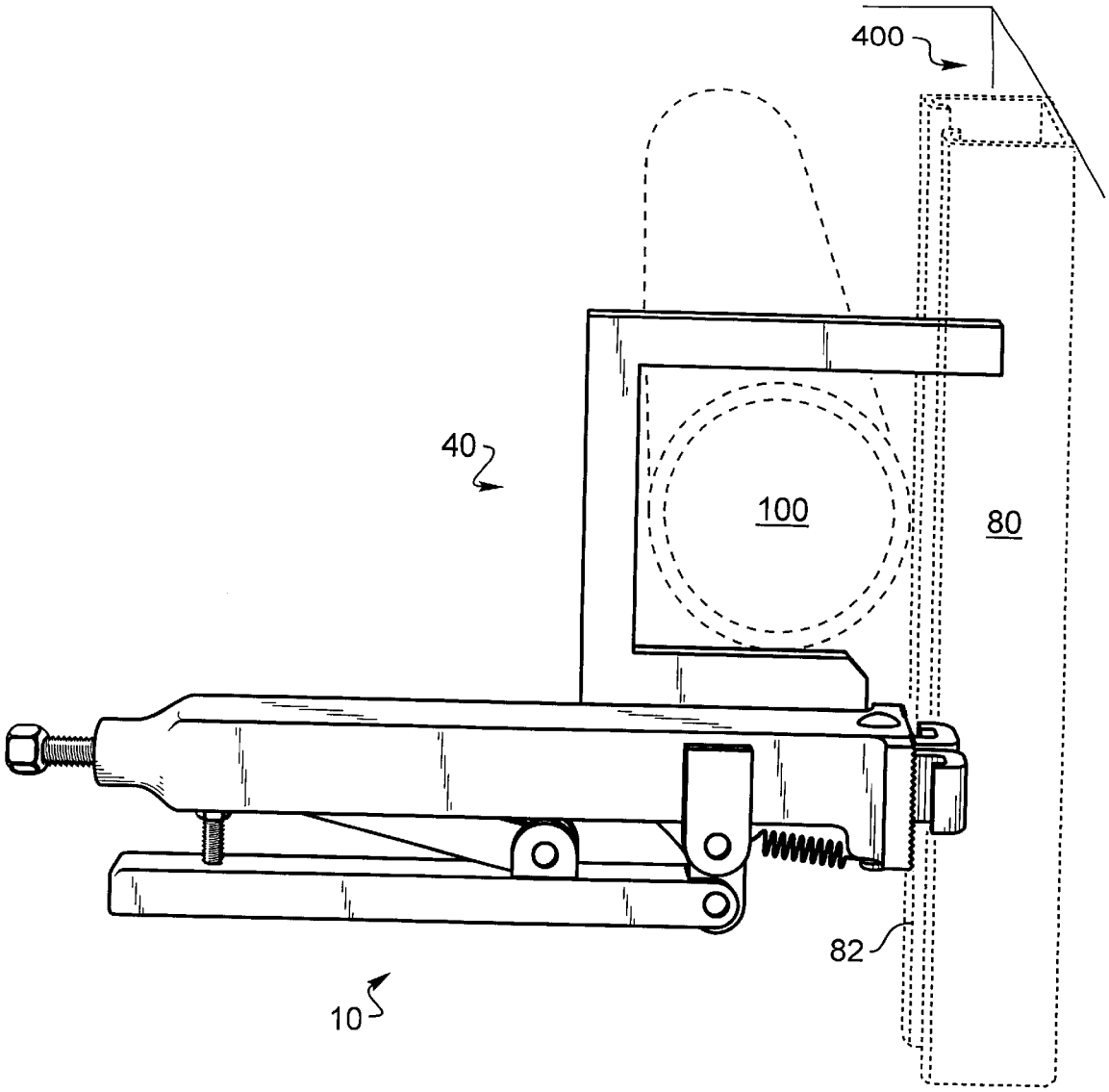
FIG. 1 is a perspective view of the clamp on a strut ready to receive a pipe, conduit or other products.

FIG. 1 shows a clamp 10 attached to a vertical strut 80 secured to a wall, for holding pipes horizontally along the wall 400. A pipe holding attachment 40 on clamp 10 defines a square bounded by the clamp 10 on the bottom, the pipe holding attachment 40 on the top and one side and the strut 80 on the other side into which a pipe may be held, such that the pipe cannot escape the area. In this manner the pipe may be held in place on one end, rather than have an assistant hold it, while being connected to another pipe and/or secured to a strut on the other end. Similarly the clamp, used in pairs can hold both ends of a pipe to make it easier to work on the pipe for connection to other pipes or securing the pipe to a strut.

Although pipes are used herein as the object held by the clamp electrical conduit or any other object can be held by this device.

Figure 2:
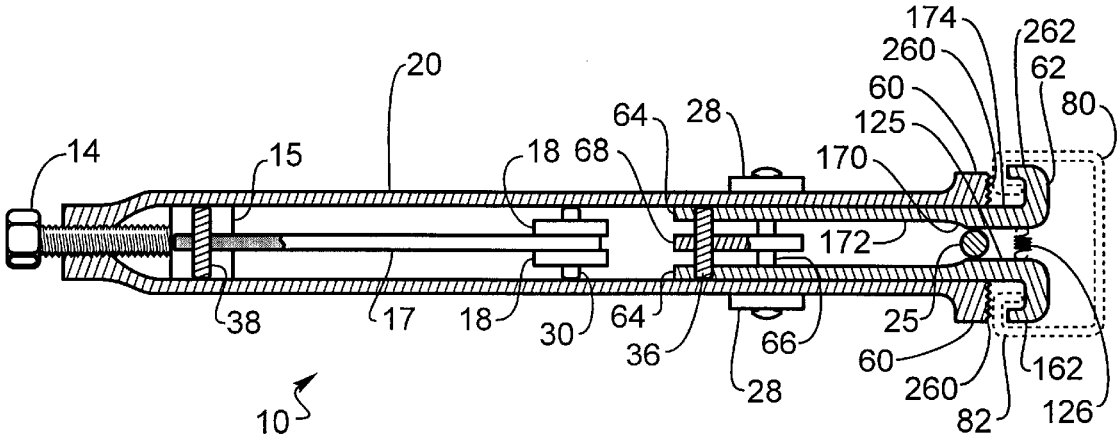
FIG. 2 is a top view of a portion of the clamp engaging a strut with the jaws in a closed position.

FIG. 2 shows the means of engaging the clamp 10 to strut 80. Struts 80 such as those made by Unistrut®, B-Line® and other manufacturers, have a C shapes with lips 82 curved inward at each end. Clamp 10 has a fixed jaw 60 and a moveable jaw 62 for engaging the lip 82 of the strut 80. In an alternative embodiment moveable jaw 62 has lip portion 162 for wrapping around the lip 82 of the strut 80 for a better grip and stronger hold.

Fixed jaw 60 and moveable jaw 62 can have a roughened or textured surfaces 260 and 262 respectively to obtain a better grip on and hold the lips 82 on struts 80.

The moveable jaws 62 are optionally biased by spring 126 to be pulled toward one another when not engaging strut 80 to better insert the moveable jaws 62 into or extract them from the strut 80. As shown when the movable jaws 62 are drawn toward fixed jaws 60 the ramped portion 170 engages spreader pin 25 and moves the moveable jaws 62 apart as they transition from the thin portion 172 to the thick portion 174. Thus as the movable jaws 62 are pulled toward the fixed jaws 60 they are pushed apart to engage the lips 82 of the strut 80. Note that the inside width of the clamp housing 20 equals the width of the spreader pin 25 and the thick portion 174 of the moveable jaw arms 64 on movable jaw 62.

Figure 3:
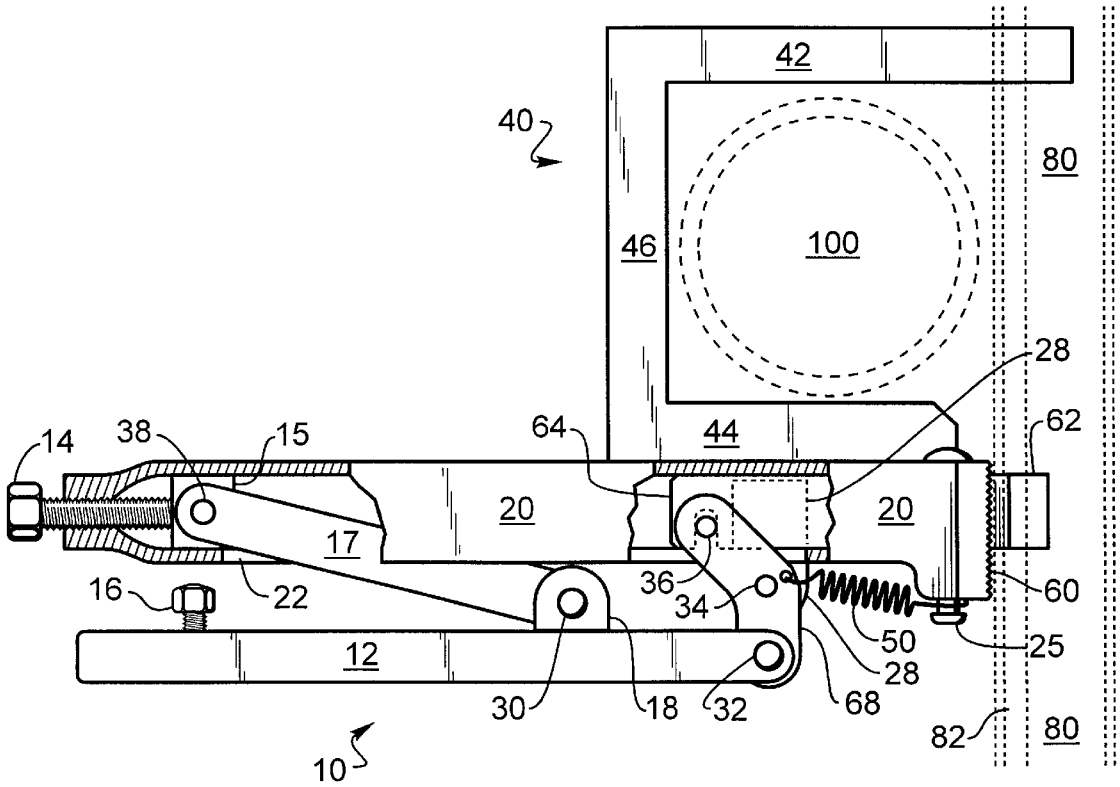
FIG. 3 is a side schematic view of the clamp.
Figure 4:
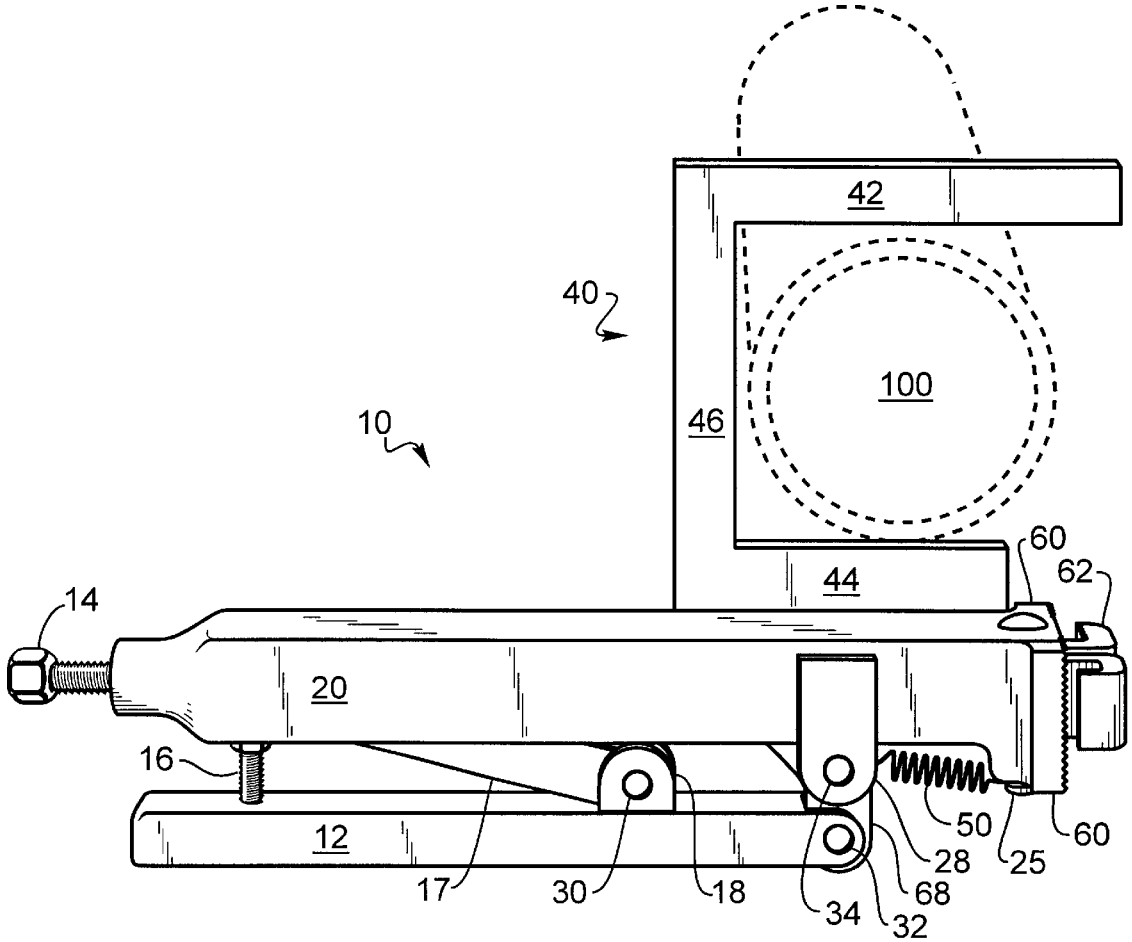
FIG. 4 is a side perspective view of the clamp.

The mechanics of tightening the clamp 10 are shown in FIG. 3. The clamp can be adjusted to tighten on any size strut 80 by turning adjustment screw 14. Adjustment screw 14 limits the travel of foot 15 in housing 20 and thereby fixes the position of maximum travel of jaw 62 and sets the pinch strength of the clamp 10. Foot 15 is pivotally connected at point 38 to swing arm 17, which is pivotally connected at point 30 to cam 18 on handle 12. Swing arm 17 passes thought slot 22 (see FIG. 9) in housing 20 to connect to pivot point 38 on foot 15. Handle 12 is pivotally connected at point 32, to actuating arm 68 which rotates on pivot point 34, on housing arm 28. The actuating arm 68 passes through slot 22 in housing 20 and is pivotally connected, at pivot point 36, to movable jaw arm 64 in housing 20 for locking the movable jaw 62 in place relative to fixed jaw 60. The actuating arm 68 is shown curved, but it could be straight, such that as the handle 12 is pulled toward the housing 20 it passes a locking point when pivot point 32 is aligned with pivot point 30. At that point, pivot point 30 goes past the straight line between pivot points 32 and 38. The handle 12 then cams over center in the arc it swings thorough and the last part of the handles' stroke is devoted to locking the handle 12 in place. The handle stop 16 is adjustable to limit the movement of the handle 12 toward the housing 20. The handle 12 is shown as being straight but it may be curved or angled.

Figure 5:
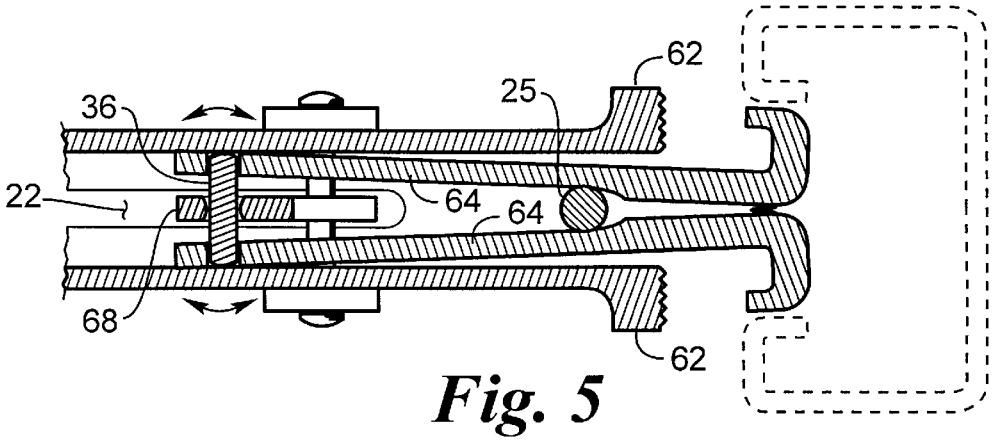
FIG. 5 is a top cross section view of the tension pin engaging the main actuating arm and the jaws extended to the open position.

The actuating arm 68 is pivotally connected to the moveable jaw arms 64 by floating tension pin 36. As best seen in FIG. 5 the actuating arm 68 preferably has a curved surface for engaging the tension pin 36 allowing the tension pin to rock such that the moveable jaw arms 64 can independently engage the strut 80 while the moveable jaws 62 are being pulled backwards toward fixed jaws 60.

As best seen in FIG. 2 showing the jaws 60, 62 in a locked position on strut 80 the moveable jaw arms 64 preferably have a straight narrow section 172, a curved section 170, and a straight thick section 174. The difference in thicknesses on the length of the moveable jaw arms 64 are for adjusting the width of the moveable jaws for engaging the struts 80. When the jaws 62 are not engaging the struts 80 they are able to move toward each other for entering or exiting the strut. The jaw arms 64 on either side of the spreader pin 25 are in the narrow portion 172 during this phase of operation as shown in FIG. 5. As the moveable jaw arms 64 are retracted by handle 12 the spreader pin 25 engages the curved section 170 pushing the moveable jaw arms 64 apart until the thick portion 174 is reached which maximizes the spreading of the moveable jaw arms 64. The thick portion 174 of moveable jaw arms 64 plus the spreader pin 25 approximates the width of the inside of the housing 20. The jaws 62 are spread apart to engage the strut lip 82 when the spreader pin 25 is adjacent the thick portion 174 of moveable jaw arms 64. A spring 126 can be used to pull the moveable jaw arms together when spreader pin 25 is adjacent the narrow portion 172 of moveable jaw arms 64.

The moveable jaw arms 64 have jaws 62 for engaging the lips 82 of strut 80. Alternatively the moveable jaw arms 64 may have a lip 162 for hooking over the lips 82 of the strut for a more secure connection. Further, roughened surface area 260 on fixed jaw 60 can enhance the grip of the jaws 60, 62 on strut 80.

Return spring 50 extends between the actuating arm 68 and the spreader pin 25 to bias the handle 12 in the unlocked position with the narrow portion 174 of moveable jaw arms 64 adjacent spreader pin 25 for ease of inserting or extracting the jaws 62 into the strut 80.

Figure 6:
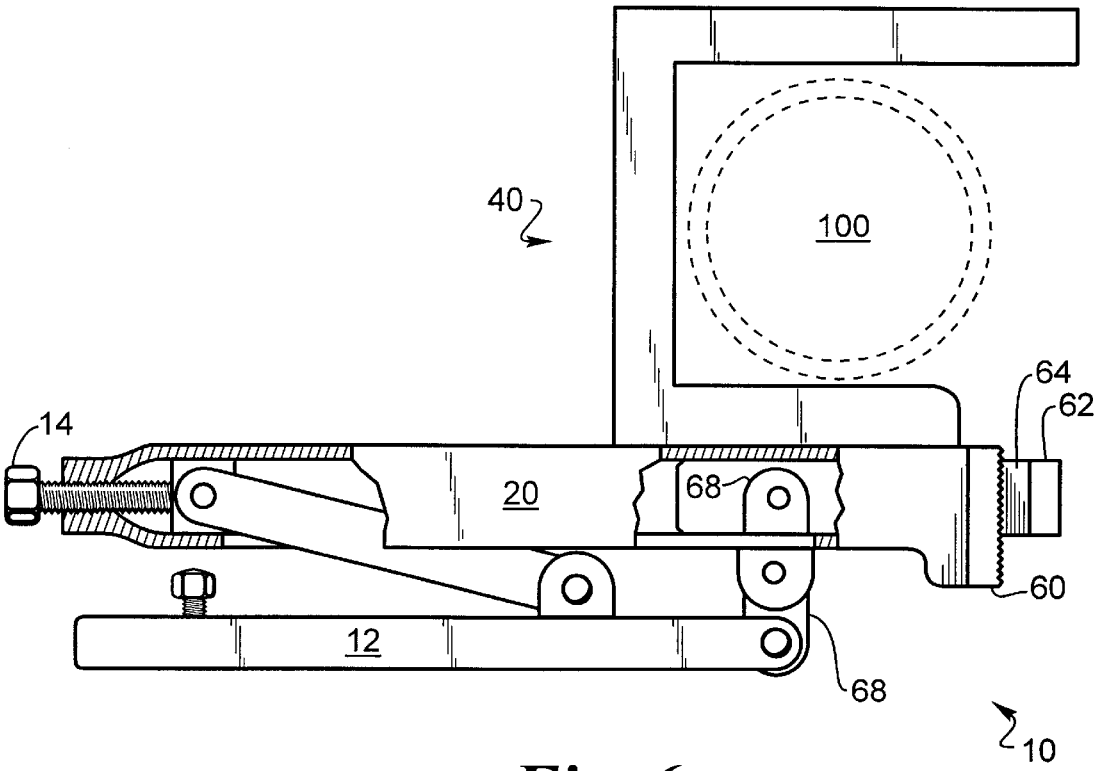
FIG. 6 is a side view of the clamp with a pipe holding attachment.
Figure 7:
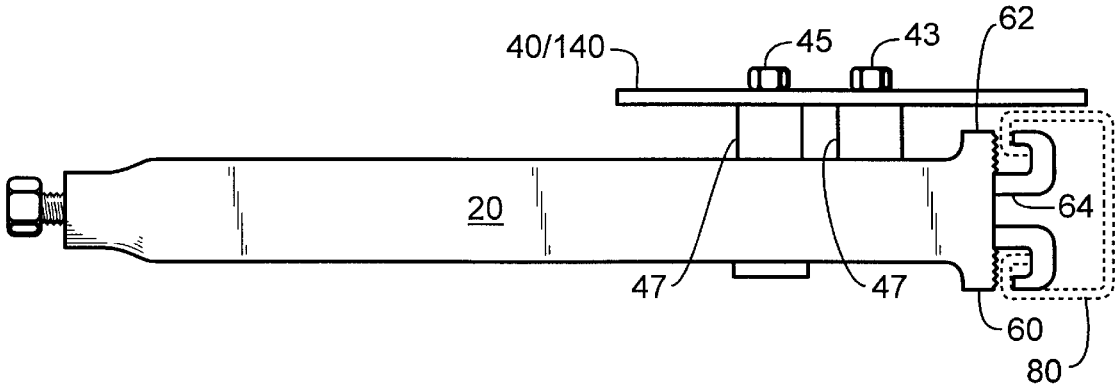
FIG. 7 is a top view of the clamp with a pipe holding attachment.
Figure 8:
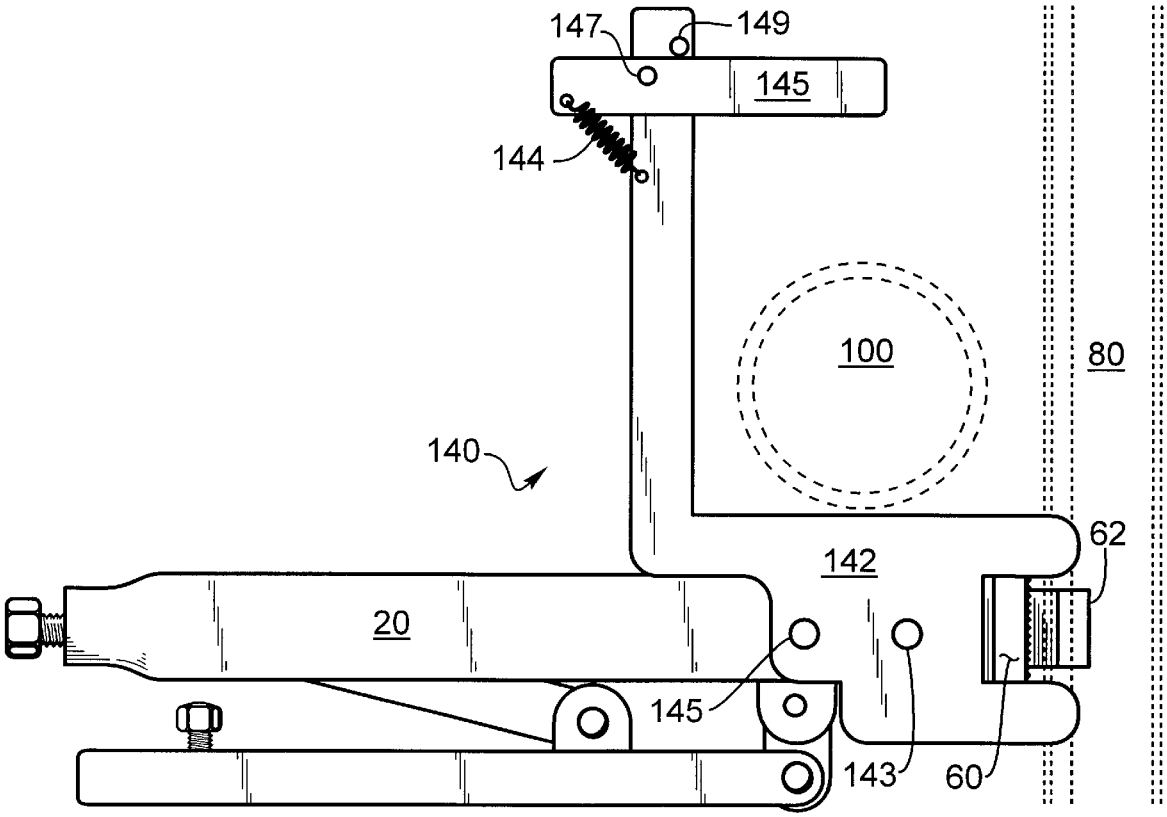
FIG. 8 is a side view of a pipe holding attachment.

Many types of attachments may be used on the housing 20. As best seen in FIG. 8, 6, 1 and 4 a pipe holding attachment 40, 140 may be bolted at apertures 43, 45, 143, 145 to the housing 20. A pipe may be inserted into the area bordered by strut 80, housing 20 and attachment 40, 140. Attachment 40, 140 may be a variety of shapes including C shaped or L shaped. When attachment 40 is C shaped as in FIG. 4, it forms a square with sides 44, 42, 46 on C shaped attachment 40 and the strut 80, to insert pipes into as shown in FIG. 1 and 6. When an L shaped attachment is used the top portion is open making it easier to insert the pipes as shown in FIG. 8. Alternatively an L shaped attachment 140, having apertures 143 and 145 for connecting the attachment to the housing 20 of clamp 10, has an arm 142 perpendicular to the housing 20. A pipe 100 can rest between the strut 80 and arm 142 on the base portion 141 of L shaped attachment 140. A spring loaded swing arm 145 on the L shaped attachment 140 allows a pipe to enter the attachment from the top by depressing the swing arm 145. Swing arm 145 will then allow a pipe to be captured as in the C shaped attachment 40. When swing arm 145 is swung downward to admit pipe 100, spring 144 will pull the swing arm 145 back to engage pin 149 leaving swing arm 145 in a position perpendicular to arm 142 and preventing pipe 100 from being removed from the capture area.

Figure 9:
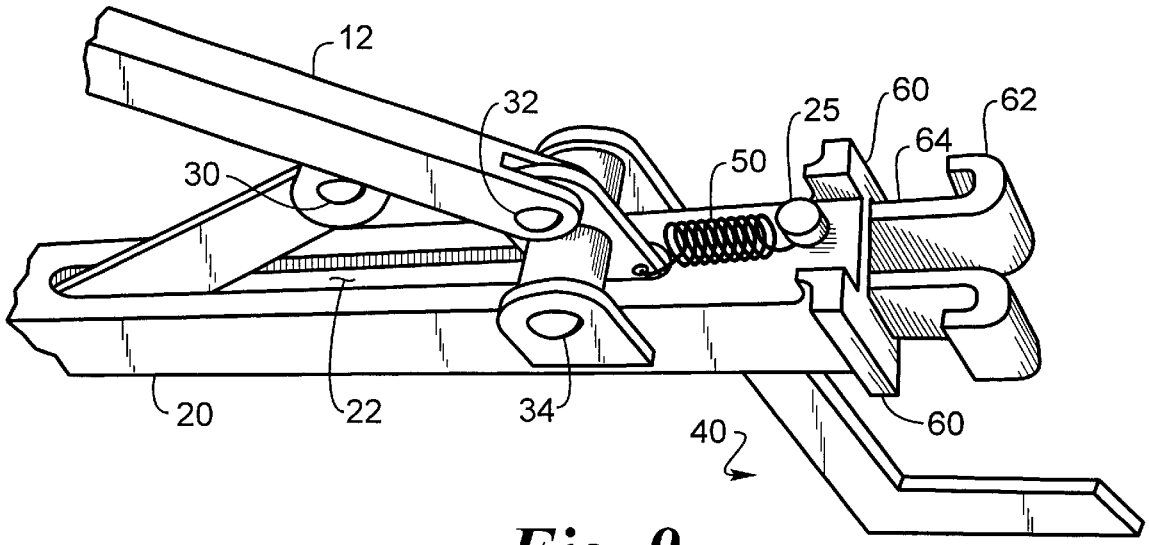
FIG. 9 is a bottom perspective view of the clamp with an attachment arm integral with the housing.

Although bolts through apertures 143 and 145 can hold attachment 140 in place along the side of the clamp housing 20 other methods of placing attachments on the housing may be used. The attachment points may also be varied on the housing 20. For example the attachment point can be on the top, or either side, or other location, of the housing 20 and be permanently or removeably attached. As shown in FIG. 9 attachment 40 may be integral with housing 20.

Figure 10:
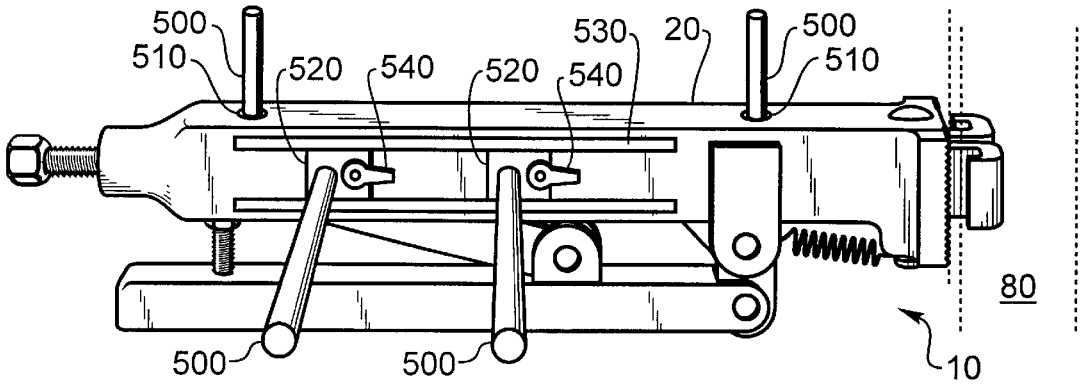
FIG. 10 shows a clamp housing with posts for engaging pipes therebetween.

FIG. 10 shows an alternative for positioning pipes relative to the housing 20. One or more posts 500 can be attached to the housing 40 such as by insertion into apertures 510 shown on the top of housing 40 or by posts 500 on pads 520 sliding in tracks 530 and locked into position by position lock 540. Pipes can be held in position either between adjacent posts 500 or between a post 500 and the strut 80 or between a post and an attachment 40, 140.

Other attachments for use with the clamp 10 such as a laser for leveling or angling (pitching) the pipes can be used. Therefore when it is desired to (pitch) angle a drain pipe for better drainage the attachment may be used to sight the angle.

For positioning pipes a laser attached to one clamp can be used to set the position of other clamps. The clamps once attached can then have the pipes held in the correct position for level or (pitched) angled piped.

Figure 11:
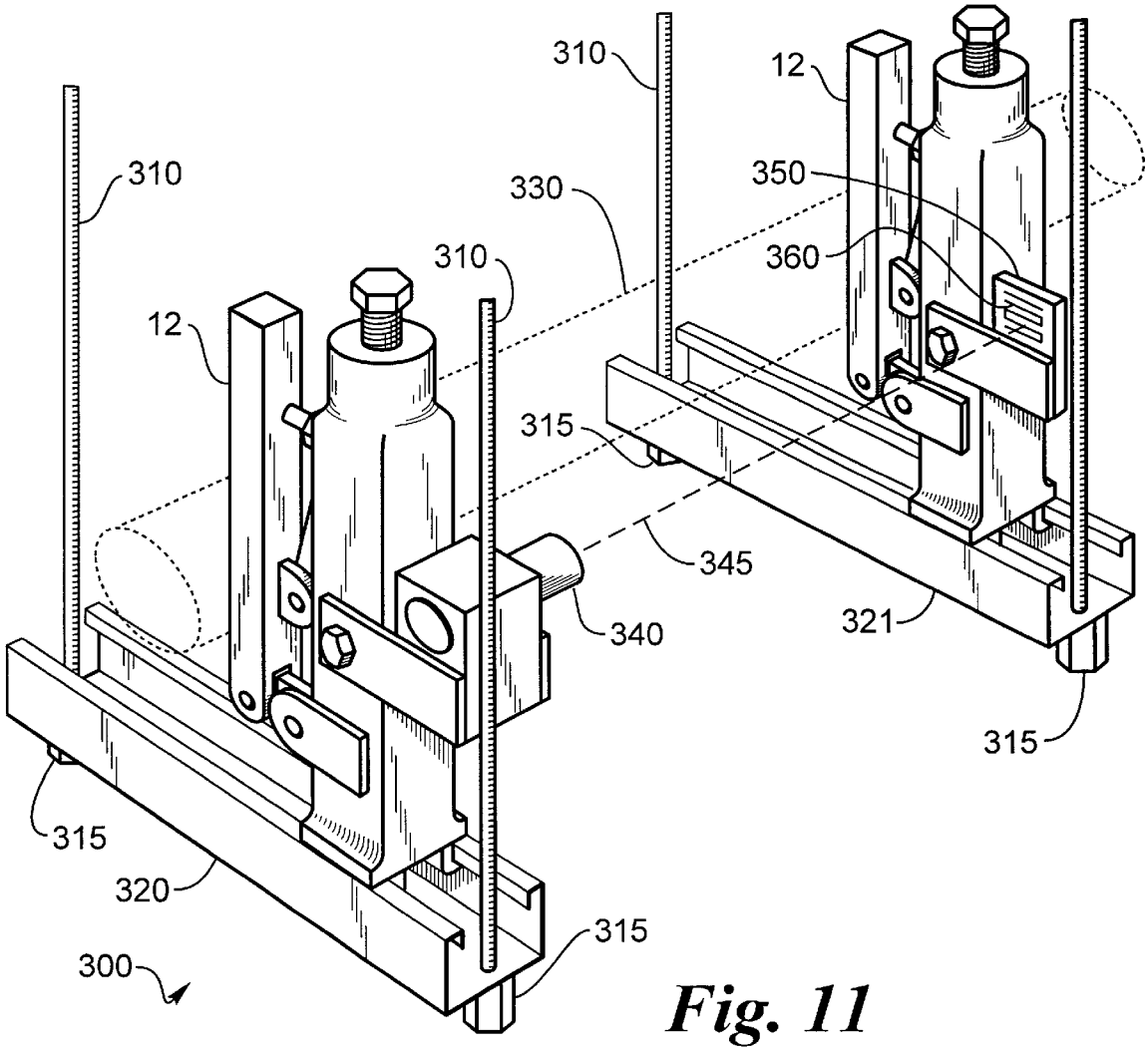
FIG. 11 shows a laser attachment on a clamp for sighting the pitch of pipes on a trapeze strut.

For example in FIG. 11 a series of trapeze struts 300 are used to hold pipes 330 from a ceiling. The trapeze struts 300 have threaded rods 310 attached to a ceiling and are adjustably connected to struts 320 by nuts 315. By adjusting the nuts 315 on the threaded rods 310 the struts 320 may be moved upward or downward on the threaded rods 310.

A clamp 10 having a laser 340 attached to the housing 20, is connected to strut 320 and laser beam 345 having an adjustable pitch is used for sighting the position of the next strut 321. The pitch adjustment of the laser 340 can be used to adjust the second strut 321 to be level with or pitched up or down from the first strut 320. The second strut 321 may have a clamp 10 with a target attachment 350 having gradient lines 360 thereon for adjusting the pitch of the second strut 321 relative to the first strut 320.

Figure 12:
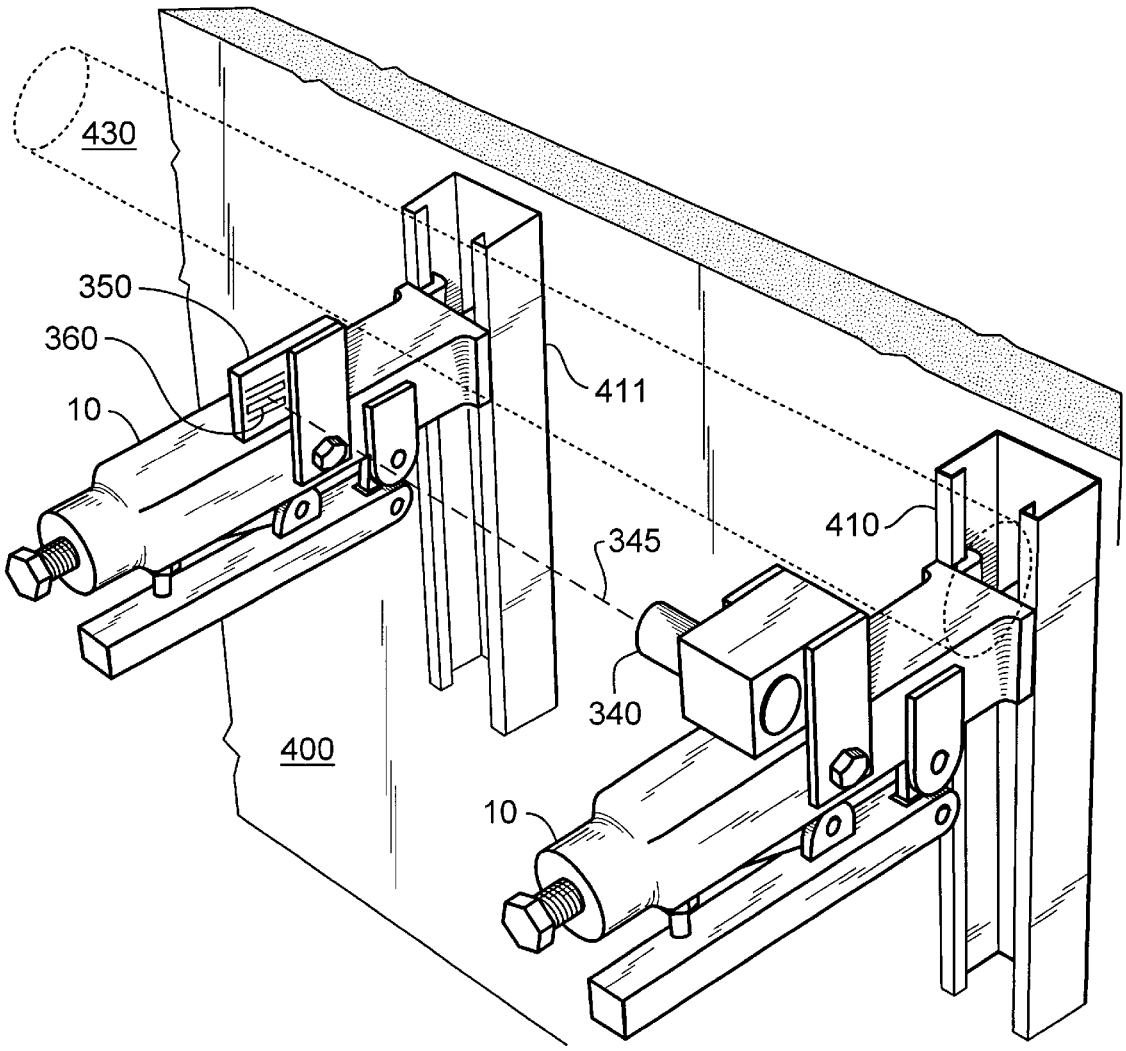
FIG. 12 shows a laser attachment on a clamp for sighting the pitch for pipes with struts attached to a wall or ceiling.

Similarly in FIG. 12 the struts 410 and 411 are attached to a wall 400. Clamps 10 with laser attachment 340 and target attachment 350 are used on the struts to position the pipes 430 being attached to the wall 400. Clamps 10 are moved to positions for supporting the pipes 430 at the desired pitch and the pipes are then rested on the clamps 10 and then attached to the struts 410 and 411.

Another attachment can be used for making angles connections between struts. A clamp at the end of one strut can hold a connector for two struts for assembling the struts either straight or at angles.

The struts 80 may be used horizontally or vertically along walls or ceilings in conjunction with the clamp 10.

The clamp 10 may be made in various sizes to fit the sizes of the struts 80 they are to engage.

The clamps 10 can be used with pipe piers having a cross section with lips similar to struts 80 for the clamp jaws 60, 62 to engage. Thus pipes 100 on pipe piers can be held in place in with clamps 10 and aligned using laser attachments 340 in the same manner as with struts 80. Pipe piers are commonly used in the building industry for holding pipes on rooftops and in above ground installations.

Obviously, many modifications and variations of the present invention are possible in light of the above teachings. It is therefore to be understood that, within the scope of the appended claims, the invention may be practiced otherwise than as specifically described.

What is claimed is:

1. A clamp comprising:

a housing having a pair of fixed jaws at one end, a pair of moveable jaws having arms extending inside of the housing, the fixed jaws and moveable jaws being opposite each other so that they may engage, a handle pivotally attached to the housing, the handle connected to the moveable jaws for sliding the moveable jaws relative to the fixed jaws, an adjustment member coupled to the housing for adjusting a locking position and pinch strength of the movable jaws relative the fixed jaws.

2. A clamp as in claim 1 wherein, a foot slides within the housing, a swing arm pivotally connected to the foot at one end and pivotally connected to the handle on the opposite end, an adjustment screw on the housing engages the foot and adjusts a stop position of the handle relative the housing.

3. A clamp as in claim 2 wherein, an actuating arm having, a pivotal connection to the to the housing, a pivotal connection to the handle, and a pivotal connection to the pair of movable jaws such that when the handle is moved the moveable jaws move until a locking position is reached.

4. A clamp as in claim 1 wherein, an actuating arm having, a pivotal connection to the to the housing, a pivotal connection to the handle, and a pivotal connection to the pair of movable jaws such that when the handle is moved the moveable jaws move until a locking position is reached.

5. A clamp as in claim 3 wherein, a spreader pin connected to the housing and positioned between the movable jaws, the pair of movable jaws each have a narrow portion a curved portion and a thick portion, such that when the thick portion is adjacent the spreader pin the jaw arms are held apart and are forced apart when the jaws are transitioning the spreader pin on the curved portion.

6. A clamp as in claim 3 wherein, a spring connects the two jaw arms to biases the jaw arms towards each other when the narrow portion of the jaw arms are opposite the spreader pin.

7. A clamp as in claim 1 wherein, the jaws on the movable jaw arm are hooked to engage a curved portion of a strut.

8. A clamp as in claim 1 wherein, the jaws have faces which are roughened to engage a potion of a strut.

9. A clamp as in claim 1 wherein, the handle is curved.

10. A clamp as in claim 1 wherein, a spring connected between the housing and the handle biases the handle to the open position with the movable jaws narrow portion adjacent the spreader pin such that the movable jaws are positioned adjacent each other for easier access to and engagement of a strut.

11. A clamp as in claim 1 wherein, a stop on the handle engages the housing to stop the movement of the handle toward the housing.

12. A clamp as in claim 1 wherein, a C shaped attachment connects to the housing.

13. A clamp as in claim 12 wherein, the C shaped attachment has a swing arm which pivots to admit an object, the swing arm having a spring attached to the C shaped attachment and a pin for stopping the swing arm from movement past a fixed position.

14. A clamp as in claim 1 wherein, a L shaped attachment connects to the housing.

15. A clamp as in claim 1 having, an attachment connected to the housing for holding objects.

16. A clamp as in claim 1 having, a laser connected to the housing for sighting pitch.

17. A clamp comprising:

a housing having at least one fixed jaw at one end, at least one moveable jaw extending inside of the housing, the at least one fixed jaw and the at least one moveable jaw being opposite each other so that they may engage, a handle pivotally attached to the housing, the handle connected to the at least one moveable jaw for sliding the at least one moveable jaw relative to the at least one fixed jaw, an adjustment member coupled to the housing for adjusting a locking position and pinch strength of the at least one movable jaw relative the at least one fixed jaw, an attachment connected to the housing for holding objects.

* * * * *

UNITED STATES PATENT AND TRADEMARK OFFICE

CERTIFICATE OF CORRECTION

PATENT NO. : 6,592,089 B1
DATED : July 15, 2003
INVENTOR(S) : Steven F. Leguil

It is certified that error appears in the above-identified patent and that said Letters Patent is hereby corrected as shown below:

Column 6,
Lines 31 and 37, please delete “to the”.
Line 59, please delete “potion” and insert -- portion --.

Signed and Sealed this

Twenty-fifth Day of November, 2003

JAMES E. ROGAN
*Director of the United States Patent and Trademark Office*